US012631421B2

(12) United States Patent
Farrell et al.

(10) Patent No.: US 12,631,421 B2
(45) Date of Patent: May 19, 2026

(54) FIREARM TRAINING SYSTEM AND METHOD OF OPERATION SUPPORTING PROGRAMMABLE SETTINGS

(71) Applicant: SMART FIREARMS TRAINING DEVICES, LLC, Tempe, AZ (US)

(72) Inventors: Michael Anthony Farrell, Tempe, AZ (US); Brian Whipple, Maricopa, AZ (US)

(73) Assignee: SMART FIREARMS TRAINING DEVICES, LLC, Tempe, AZ (US)

( * ) Notice: Subject to any disclaimer, the term of this patent is extended or adjusted under 35 U.S.C. 154(b) by 419 days.

(21) Appl. No.: 18/221,299

(22) Filed: Jul. 12, 2023

(65) Prior Publication Data

US 2025/0020428 A1 Jan. 16, 2025

(51) Int. Cl.
*F41A 33/02* (2006.01)
*F41A 19/01* (2006.01)
*F41A 33/04* (2006.01)

(52) U.S. Cl.
CPC ..... *F41A 33/02* (2013.01); *F41A 19/01* (2013.01); *F41A 33/04* (2013.01)

(58) Field of Classification Search
CPC ..... F41A 33/00; F41A 33/02; F41A 33/04; F41A 33/06; F41A 19/01; F41G 3/26
See application file for complete search history.

(56) References Cited

U.S. PATENT DOCUMENTS

2016/0169608 A1* 6/2016 Schulz ..... F41A 33/02 434/22
2020/0333096 A1* 10/2020 Galie ..... F41A 19/01

* cited by examiner

*Primary Examiner* — Timothy A Musselman
(74) *Attorney, Agent, or Firm* — Alleman Hall LLP

(57) ABSTRACT

A firearm training system comprises a firearm training device that includes: a device body; a trigger; a trigger sensor; a laser emitter; and an electronic control system. The electronic control system has settings data stored thereon that includes one or more laser settings that defines a pulse length and/or an emission duration of the laser. The electronic control system is configured to: responsive to actuation of the trigger, control the laser emitter to emit the laser at the pulse length and/or the emission duration defined by the one or more laser settings; receive a command to change a laser setting of the one or more laser settings; and update the laser setting based on the command to vary the pulse length and/or the emission duration of the laser to be emitted by the laser emitter responsive to actuation of the trigger.

20 Claims, 5 Drawing Sheets

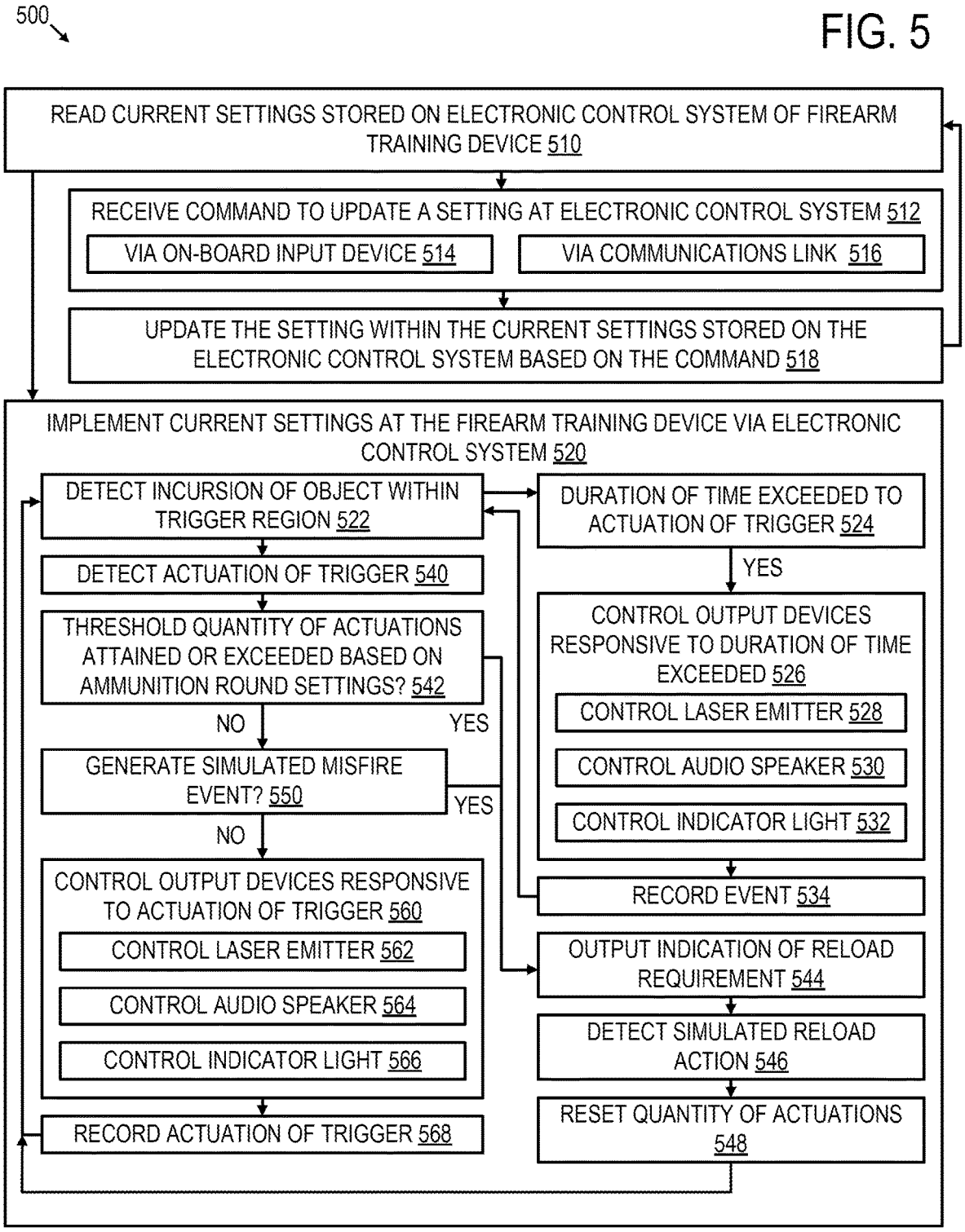
500
FIG. 5
READ CURRENT SETTINGS STORED ON ELECTRONIC CONTROL SYSTEM OF FIREARM TRAINING DEVICE 510
RECEIVE COMMAND TO UPDATE A SETTING AT ELECTRONIC CONTROL SYSTEM 512
VIA ON-BOARD INPUT DEVICE 514
VIA COMMUNICATIONS LINK 516
UPDATE THE SETTING WITHIN THE CURRENT SETTINGS STORED ON THE ELECTRONIC CONTROL SYSTEM BASED ON THE COMMAND 518
IMPLEMENT CURRENT SETTINGS AT THE FIREARM TRAINING DEVICE VIA ELECTRONIC CONTROL SYSTEM 520
DETECT INCURSION OF OBJECT WITHIN TRIGGER REGION 522
DURATION OF TIME EXCEEDED TO ACTUATION OF TRIGGER 524
YES
DETECT ACTUATION OF TRIGGER 540
THRESHOLD QUANTITY OF ACTUATIONS ATTAINED OR EXCEEDED BASED ON AMMUNITION ROUND SETTINGS? 542
NO
YES
CONTROL OUTPUT DEVICES RESPONSIVE TO DURATION OF TIME EXCEEDED 526
CONTROL LASER EMITTER 528
CONTROL AUDIO SPEAKER 530
CONTROL INDICATOR LIGHT 532
GENERATE SIMULATED MISFIRE EVENT? 550
YES
NO
CONTROL OUTPUT DEVICES RESPONSIVE TO ACTUATION OF TRIGGER 560
CONTROL LASER EMITTER 562
CONTROL AUDIO SPEAKER 564
CONTROL INDICATOR LIGHT 566
RECORD EVENT 534
OUTPUT INDICATION OF RELOAD REQUIREMENT 544
DETECT SIMULATED RELOAD ACTION 546
RECORD ACTUATION OF TRIGGER 568
RESET QUANTITY OF ACTUATIONS 548

FIREARM TRAINING SYSTEM AND METHOD OF OPERATION SUPPORTING PROGRAMMABLE SETTINGS

BACKGROUND

Firearm training devices can be used to facilitate the training of firearm usage, including shot accuracy and safe handling. Such devices can simulate functioning firearms by incorporating a trigger and a laser that simulates a firing trajectory of the firearm that is emitted responsive to actuation of the trigger. Some firearm training devices feature sensor-based monitoring of a region surrounding the trigger for training hand positioning.

SUMMARY

A firearm training system and a method of operation are disclosed. The firearm training system includes a firearm training device that simulates a firearm. The firearm training device supports programmable settings that can be implemented by an electronic control system on-board the device to control various device components and their respective operations.

According to an example of the present disclosure, a firearm training system comprises a firearm training device that includes: a device body that takes the form of a simulated firearm; a trigger moveably coupled to the device body; a trigger sensor mounted to the device body to detect actuation of the trigger; a laser emitter mounted to the device body and configured to emit a laser along a path that simulates a firing trajectory of the simulated firearm; and an electronic control system mounted to the device body.

The electronic control system has settings data stored thereon that includes one or more laser settings that defines a pulse length and/or an emission duration of one or more pulses of the laser to be emitted by the laser emitter. The electronic control system is configured to, responsive to actuation of the trigger as detected via the trigger sensor, control the laser emitter to emit the laser at the pulse length and/or the emission duration defined by the one or more laser settings stored on the electronic control system. The electronic control system is further configured to receive a command to change a laser setting of the one or more laser settings stored on the electronic control system that defines the pulse length and/or the emission duration of the laser to be emitted by the laser emitter. The electronic control system is further configured to update the laser setting stored on the electronic control system based on the command to vary the pulse length and/or the emission duration of the laser to be emitted by the laser emitter responsive to actuation of the trigger as detected via the trigger sensor. Additional settings that can be supported by the firearm training system are described in further detail herein.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

BRIEF DESCRIPTION OF THE DRAWINGS

FIG. 5 is a flow diagram depicting an example method that can be performed by an electronic control system of the firearm training device of FIG. 1.

DETAILED DESCRIPTION

Figure 1:
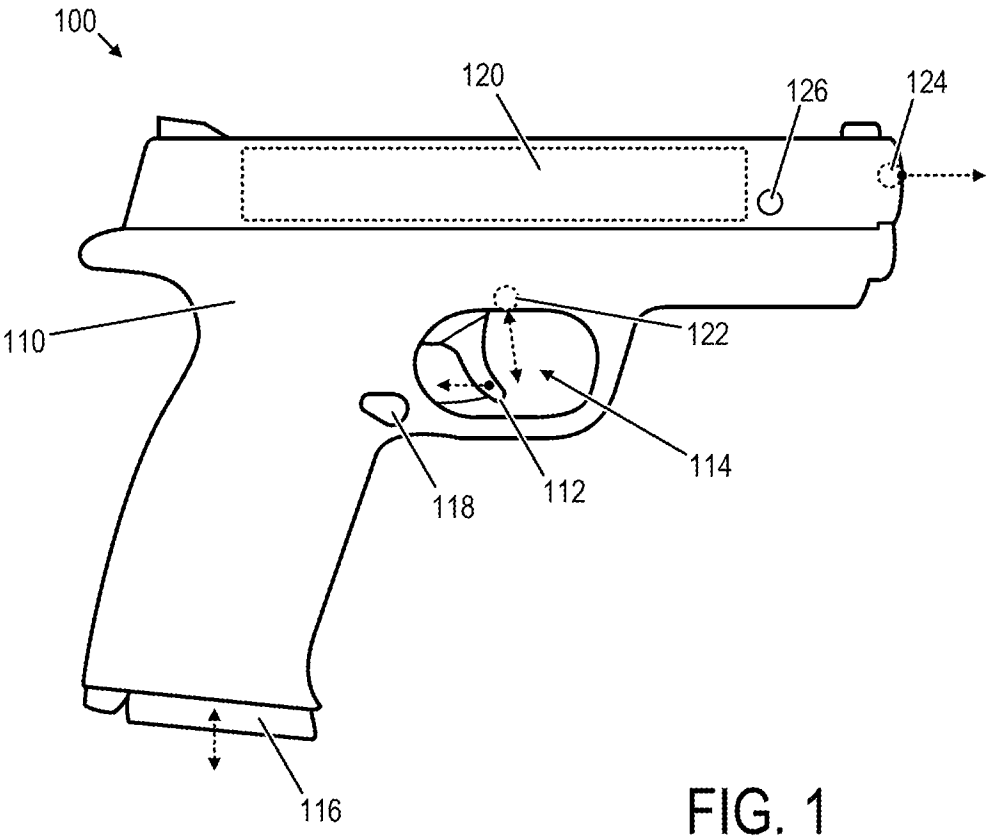
FIG. 1 is a schematic diagram depicting an example firearm training device.

As briefly introduced above, firearm training devices can be used to facilitate the training of firearm usage, including shot accuracy and safe handling. Such devices can simulate functioning firearms by incorporating a trigger and a laser that simulates a firing trajectory of the firearm that is emitted responsive to actuation of the trigger. Some firearm training devices feature sensor-based monitoring of a region surrounding the trigger for training hand positioning.

A disadvantage of existing firearm training devices is the inability for users to adjust settings of the device within the field. For example, existing targeting systems monitor and detect simulated shot locations by optically monitoring a pulse length of one or more pulses of a laser that is output by the training device responsive to trigger actuation. In this example, the targeting systems distinguish between multiple training devices within a practice range based on the pulse length of individual pulses and/or an overall duration of multiple pulses of the laser that are output responsive to each trigger actuation. Within this context, one approach relies on firearm training devices having preset pulse lengths and/or overall duration of multiple pulses of the laser that differ between devices to enable operation of the devices to be distinguished by the targeting system. Typically, the pulse length and overall duration of the pulses are preset at the factory, for example, prior to or as part of assembly of the training device. This approach has the disadvantage of not allowing a user to use their own firearm training device, as their device may not utilize a pulse length or multi-pulse duration that is distinguishable from other devices or otherwise recognizable by the targeting system. Additionally, the use of preset laser profiles for firearm training devices does not allow those devices to be used with targeting systems that support a different range of laser profiles, such as a different range of pulse widths and/or overall multi-pulse durations.

A firearm training system and a method of operation are disclosed that offers the potential to address the above disadvantages. The firearm training system includes a firearm training device that simulates a firearm. The firearm training device supports programmable settings that can be implemented by an electronic control system on-board the device to control various device components and their respective operations. Settings can be updated responsive to commands initiated via an input device of the firearm training device and/or over a wireless or wired communications link with a remote computing system. The disclosed approach enables users to change various settings implemented by the firearm training device without requiring disassembly of the device or special-purpose tools.

According to an example of the present disclosure, a firearm training system comprises a firearm training device that includes: a device body that takes the form of a simulated firearm; a trigger moveably coupled to the device body; a trigger sensor mounted to the device body to detect actuation of the trigger; a laser emitter mounted to the device body and configured to emit a laser along a path that simulates a firing trajectory of the simulated firearm; and an electronic control system mounted to the device body.

The electronic control system has settings data stored thereon that includes one or more laser settings that defines a pulse length and/or an emission duration of one or more pulses of the laser to be emitted by the laser emitter. The electronic control system is configured to, responsive to actuation of the trigger as detected via the trigger sensor, control the laser emitter to emit the laser at the pulse length and/or the emission duration defined by the one or more laser settings stored on the electronic control system. The electronic control system is further configured to receive a command to change a laser setting of the one or more laser settings stored on the electronic control system that defines the pulse length and/or the emission duration of the laser to be emitted by the laser emitter. The electronic control system is further configured to update the laser setting stored on the electronic control system based on the command to vary the pulse length and/or the emission duration of the laser to be emitted by the laser emitter responsive to actuation of the trigger as detected via the trigger sensor. Additional settings that can be supported by the firearm training system are described in further detail herein.

The disclosed firearm training system and firearm training device thereof offers the potential to address the above disadvantages as well as other disadvantages of products within the industry. For example, by enabling a user to adjust the pulse length and/or emission duration of the laser across one or more pulses through input provided via the training device or via another device via a wireless communications link, users can adjust operation of the laser emitter in a manner that permits use of the firearm training device at practice ranges employing targeting systems that require specific operation of the laser. Such adjustment does not require disassembly of the firearm training device or special-purpose equipment.

FIG. 1 is a schematic diagram depicting an example firearm training device 100 that takes the form of a simulated firearm. In this example, device 100 takes the form of a simulated handgun. It will be understood that device 100 can take the form of other simulated firearm form factors, including rifles, revolvers, etc.

Device 100 includes a device body 110 and a trigger 112 rotatably coupled to the device body. Trigger is disposed within a trigger region 114. In this example, trigger region 114 is defined, at least in part, by a trigger guard portion of the device body. Trigger 112 can be actuated by pulling the trigger as indicated by the arrow in FIG. 1, thereby simulating a trigger of a functioning firearm. Device 100 further includes a releasable simulated ammunition magazine 116 that can be released from a receptacle formed in device body 110 by actuating a magazine release actuator 118.

Firearm training device 100 includes an electronic control system 120, depicted schematically in FIG. 1, that can control input and output devices of the firearm training device. Electronic control system 120 is mounted to device body 100, and can be housed within device body 110, as an example.

FIG. 1 depicts some of the input and output devices of device 100. Additional examples of input and output devices of device 100 are described in further detail with reference to FIG. 2. As an example, device 100 includes a trigger region incursion sensor 122 that detects incursion of an object (e.g., a finger) into or within trigger region 114. Sensor 122 can detect incursion of objects via optical sensing in at least some examples. For example, sensor 122 can include an illumination source and an optical receiver that is capable of detecting objects within a threshold distance of the sensor. Examples of sensor 122 suitable for detecting incursion of an object into trigger region 114 are described in further detail by U.S. Pat. Nos. 7,506,468 and 9,658,022 incorporated herein by reference for all purposes.

Device 100 further includes a laser emitter 124, which can include a visible light laser emitter that emits a visible light laser and/or an infrared light laser emitter that emits an infrared laser, as examples. It will be understood that other wavelengths of electromagnetic radiation can be supported by the laser emitter. A laser emitted by laser emitter 124 can be directed along a path that simulates a firing trajectory of the simulated firearm of device 100. Laser emitter 124 can be controlled by electronic control system 120 to emit a laser responsive to trigger 112 being actuated. As an example, electronic control system 120 can control laser emitter 124, responsive to actuation of trigger 112, to emit one or more pulses of the laser having a defined pulse length for each pulse and overall emission duration of the one or more pulses. In this example, the emission duration can define a quantity of pulses of a given pulse length.

Device 100 further includes an indicator light 126 that can be controlled by electronic control system 120 to emit light according to one or more predefined patterns and/or one or more predefined colors responsive to various conditions. As an example, electronic control system 120 can control indicator light 126 to emit a flashing light of a first color (e.g., red) responsive to detecting, via sensor 122, incursion of an object (e.g., finger) into trigger region 114 for a threshold period of time prior to actuation of trigger 112. In this example, indicator light 126 can provide visual feedback to the user and/or training instructor that the user's finger was improperly placed near or on the trigger without actuating the trigger or too far in advance of trigger actuation. As another example, electronic control system 120 can control indicator light 126 to emit light of a second color (e.g., green) during a pairing operation with another device. As yet another example, electronic control system 120 can control indicator light 126 to emit a light of a predefined color responsive to actuation of trigger 112. As yet another example, electronic control system 120 can control indicator light 126 to emit a light of a predefined color responsive to a simulated reload requirement in which the user is required to simulate reloading device 100.

Figure 2:
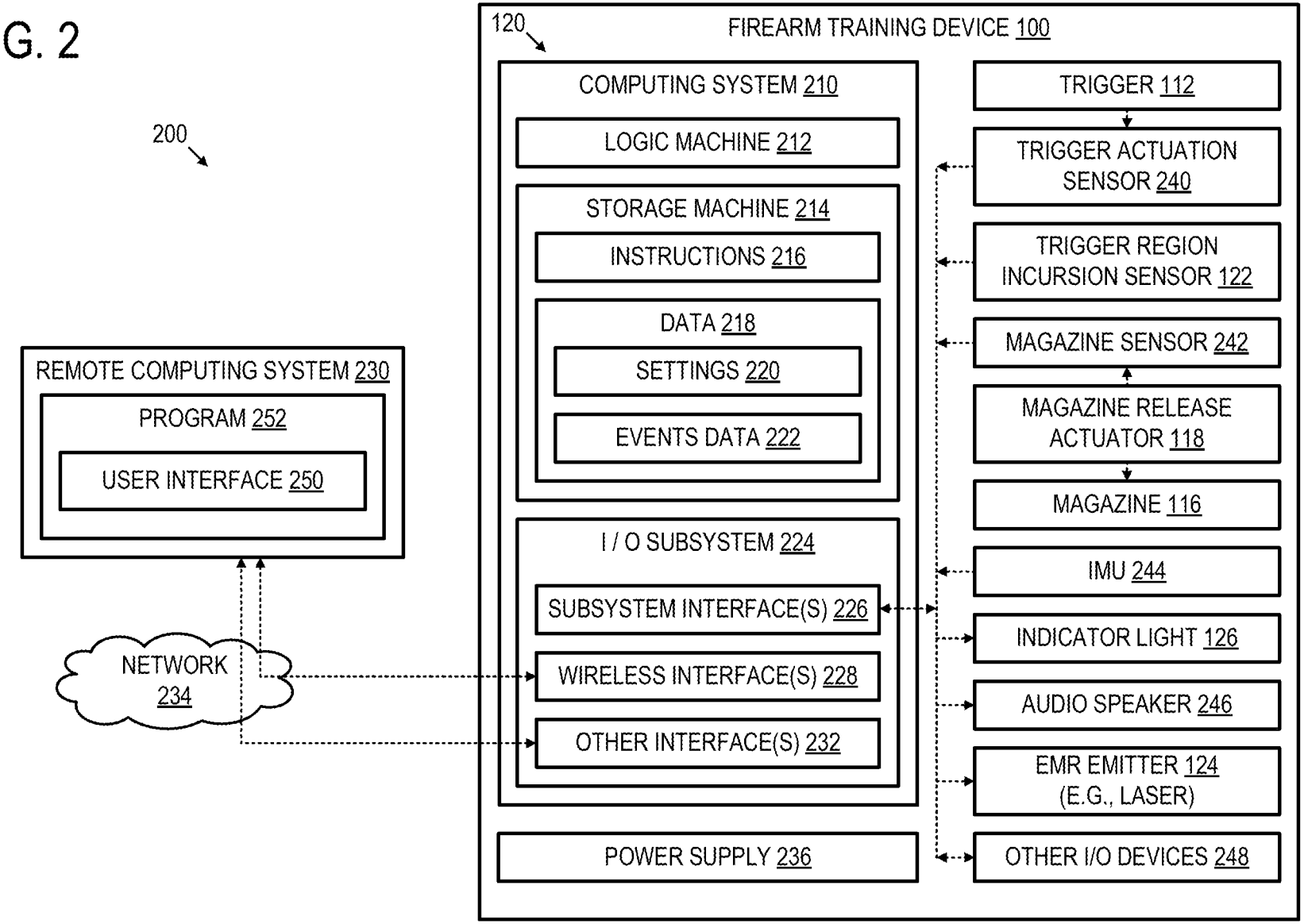
FIG. 2 is a schematic diagram depicting an example firearm training system that includes the firearm training device of FIG. 1.

FIG. 2 is a schematic diagram depicting an example firearm training system 200 that includes firearm training device 100 of FIG. 1, represented in block diagram form.

In this example, electronic control system 120 comprises a computing system 210 that includes a logic machine 212 and a storage machine 214. Aspects of logic machine 212 and storage machine 214 are described in further detail herein. Briefly, logic machine 212 can include one or more logic devices that can execute instructions 216 and process data 218 stored at storage machine 214. Examples of data 218 include settings 220 and events data 222.

Computing system 210 further includes an input/output (I/O) subsystem 224 by which the computing system interfaces with input devices and output devices of firearm training device 100, as well as remote devices located off-board device 100. In this example, I/O subsystem 224 includes one or more subsystem interfaces 226 by which computing system 210 interfaces with input devices and output devices located on-board device 100. I/O subsystem 224 further includes one or more wireless interfaces 228 by which device 100 can wirelessly communicate via a wireless communications link with remote devices, such as a remote computing system 230. I/O subsystem 224 further includes one or more other interfaces 232 (e.g., a wired interface and/or physical data connector) by which device 100 can communicate with remote devices, such as remote computing system 230.

Communications via interfaces 228 and 232 with remote devices such as remote computing system 230 can traverse one or more communications networks, represented schematically as network 234 in FIG. 2. Network 234 can include one or more of a personal area network, a local area network, and/or a wide area network (e.g., the Internet). Wireless interfaces 228, for example, can support wireless communications over network 234 via one or more wireless protocols, such as Bluetooth, Wi-Fi, NFC, etc.

Device 100 can include an on-board power supply 236 (e.g., one or more batteries) for powering electronic components of device 100, including computing system 210, the input devices, and the output devices of the device described in further detail herein. Power supply 236 can be recharged by receiving energy from a source located off-board device 100, such as via interfaces 228 or 232, as examples.

Device 100 includes a trigger actuation sensor 240 by which actuation of trigger 112 (e.g., a trigger pull) can be detected by electronic control system 120. Electronic control system 120 or computing system 210 thereof can store data identifying actuation events of trigger 112 within events data 222 and perform operations responsive to actuation events of trigger 112. As another example, electronic control system 120 or computing system 210 thereof can store data identifying trigger region incursion events as detected via trigger region incursion sensor 122, and can perform operations responsive to such incursion events. In these and other examples, each event that is recorded within events data 222 can take the form of a data set that includes a time stamp, an event-type identifier, and other associated information describing the event.

Device 100 includes a magazine sensor 240 by which actuation of magazine release actuator 118 and/or the presence or absence of magazine 116 within the receptacle of device body 110 can be detected by electronic control system 120. For example, electronic control system 120 or computing system 210 thereof can store data identifying actuation events of magazine 116 within events data 222, including the release, removal, and reinsertion of magazine 116 relative to the receptacle of device body 110, and can perform operations responsive to such actuation events.

Device 100 includes an inertial measurement unit 244 of one or more inertial devices by which a spatial orientation and/or movement of device 100 can be detected by electronic control system 120. Electronic control system 120 or computing system 210 thereof can store data identifying inertial events detected via IMU 244 within events data 222, and can perform operations responsive to such inertial events. As an example, electronic control system 120 can power on other components of device 100 responsive to detecting that the device has been picked up, and can power off some or all components of the device responsive to detecting that the device has not been moved for a threshold period of time.

Device 100 includes an audio speaker 246 that can be controlled by electronic control system 120 to output audio segments responsive to predefined conditions. As an example, electronic control system 120 or computing system 210 thereof can output a sound that includes or simulates firing of one or more rounds of ammunition responsive to actuation of trigger 112. As another example, audio speaker 246 can be controlled to output a sound simulating a misfire event. As yet another example, audio speaker 246 can be controlled to output a sound responsive to an object being detected within the trigger region for a threshold period of time before the trigger is actuated.

It will be understood that device 100 can include one or more other I/O devices, including sensors, output devices, communications interfaces, etc. not depicted in FIG. 2.

Referring again to remote computing system 230, in at least some examples, the remote computing system can include or take the form of a computing device that provides a user interface 250 by which a user can interact with various features of device 100. As an example, user interface 250 can take the form of a graphical user interface that is presented via a graphical display of a smartphone, handheld computer, laptop computer, or desktop computer. As described in further detail with reference to FIG. 4, user interface 250 can present settings 220 stored on storage machine 214 of device 100, and enable a user to change settings 220 via one or more settings tools. User interface 250 can form part of a computer program 252 executed by remote computing system 230, such as an application program, for example.

Figure 3:
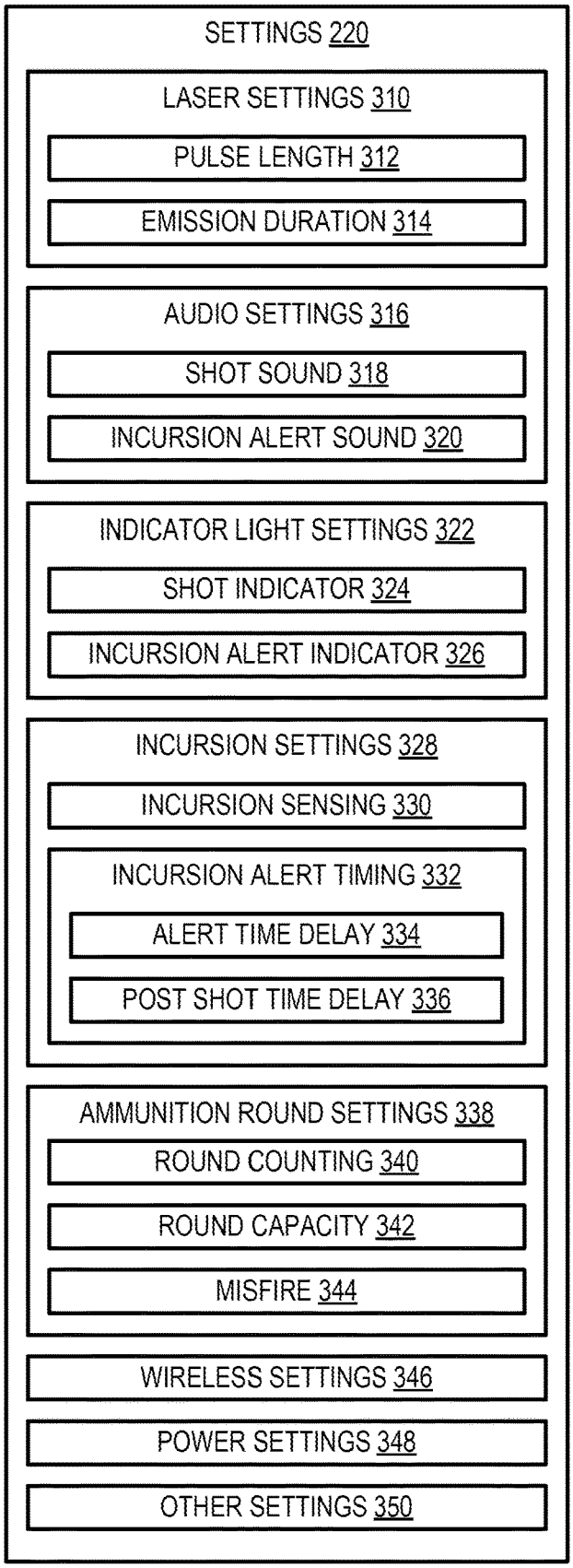
FIG. 3 is a schematic diagram depicting example settings that can be implemented at the firearm training device of FIG. 1 and that can be adjusted by a user.

FIG. 3 is a schematic diagram depicting example settings 220 that can be implemented at the firearm training device of FIG. 1 by electronic control system 120. As an example, each setting of settings 220 includes one or more data values that can be read by electronic control system 120 to implement the various functions described herein. Settings 220 can be adjusted by a user, for example, by selecting or providing one or more data values that are updated within settings 220 by electronic control system 120. Some of settings 220 can include a value that defines either an activated state of the setting or a deactivated state of the setting. In this example, the value includes one of two values selected from a set of binary values. Some settings 220 can include a value within a range of values that are supported by the firearm training device.

As previously described with reference to FIG. 2, settings 220 can be stored on electronic control system 120 of firearm training device 100. In this example, settings 220 can take the form of settings data stored within storage machine 214 as part of data 218, for example. Settings 220 stored as data within storage machine 214 can be read or otherwise accessed by electronic control system 120 to inform control operations to be performed by the electronic control system. Settings 220 can be updated by electronic control system 120 responsive to commands initiated by a user.

Settings 220 can include one or more laser settings 310 associated with laser emitter 124. The one or more laser settings can define a pulse length 312 of individual pulses of the laser and/or an emission duration 314 of one or more of the pulses of the laser to be emitted by the laser emitter, as examples. In this example, the pulse length can refer to a duration of time that the laser is activated for each pulse (e.g., 100 milliseconds), and the emission duration can refer to a total duration of time that the laser is activated for one or more pulse length cycles between which the laser is deactivated. Laser settings 310 are examples of output settings for an output device (e.g., a laser emitter) located on-board the firearm training device.

Settings 220 can include one or more audio settings 316 for controlling operation of audio speaker 246, as another example of output settings for an output device of the firearm training device. As an example, audio settings 316 includes a shot sound setting 318 that defines whether a shot sound is to be output via audio speaker 246 responsive to actuation of the trigger. In this example, electronic control system 120 outputs the shot sound when shot sound setting 318 is set to the activated state. As another example, audio settings 316 can include an incursion alert sound setting 320 that defines whether an incursion alert sound is to be output responsive to detecting incursion of an object within the trigger region for a threshold duration of time prior to actuation of the trigger. In this example, electronic control system 120 outputs the incursion alert sound when incursion alert sound setting 320 is set to the activated state.

Settings 220 can include one or more indicator light settings 322 for indicator light 126 as another example of output settings for an output device of the firearm training device. As an example, indicator light settings 322 can include a shot indicator setting 324 that defines whether the indicator light is controlled to output light a predefined color and/or pattern that serves as a shot indicator responsive to actuation of the trigger. In this example, electronic control system 120 outputs the light when shot indicator setting 324 is set to the activated state. As another example, indicator light settings 322 can include an incursion alert indicator setting 326 that defines whether the indicator light is controlled to output light of a predefined color and/or pattern that serves as an indicator of trigger region incursion responsive to incursion of an object within the trigger region.

Settings 220 can include one or more trigger region incursion settings 328 that define one or more settings associated with detecting incursion of an object within trigger region 114 via sensor 122. As an example, incursion sensing setting 330 defines whether incursion detection is activated or deactivated. As another example, incursion alert timing settings 332 includes an alert time delay setting 334 that defines a duration of time (e.g., within a range of 0.5 seconds to 5 seconds) between incursion of an object within the trigger region as detected via the trigger region incursion sensor and actuation of the trigger as detected via the trigger sensor. As another example, incursion alert timing settings 332 includes a post shot time delay setting 336 that defines a duration of time (e.g., within a range of 0.5 seconds to 5 seconds) between actuation of the trigger as detected via the trigger sensor and initiating a subsequent incursion detection phase. Settings 334 and 336 can each include a value within a supported range of values that identifies a duration of time.

Settings 220 can include one or more ammunition round settings 338 that define aspects of simulated ammunition usage by the firearm training device. For example, ammunition round settings can include an ammunition round counting setting 338, a simulated ammunition round capacity setting 342 for the firearm training device, and a misfire setting 344. Round counting setting 340 defines activated or deactivated states for a reload requirement being enforced by the electronic control system upon a quantity of actuations of the trigger attaining or exceeding a threshold value as defined by round capacity setting 342. For example, when round counting setting 340 is activated, the electronic control system records a quantity of actuations of the trigger as detected via the trigger sensor between consecutive simulated reload actions as detected via the magazine sensor; responsive to the quantity of actuations of the trigger attaining or exceeding the threshold quantity, the electronic control system can output an indication of a reload requirement; and the electronic control system can reset the quantity of actuations to zero responsive to each simulated reload action being performed by the user. Round capacity setting 342 can include a value range of 1 through X, where X is an integer greater than 1.

Ammunition round settings 338 can further define activation or deactivation of a simulated misfire event state, as identified by misfire setting 344. The electronic control system can generate (e.g., randomly or at a predefined frequency) one or more simulated misfire events based on the one or more ammunition round settings defining activation of the simulated misfire event state, and responsive to each simulated misfire event being generated, the electronic control system outputs an indication of the reload requirement. The simulated misfire event can be cleared or reset responsive to detecting a simulated reload action, such as via the magazine sensor, for example.

Settings 220 further include one or more wireless settings 346 that define aspects of device pairing, wireless protocols, and other settings suitable for establishing a wireless communications link between the firearm training device and another remote device, such as remote computing system 230. Settings 220 further include one or more power settings 348 that define aspects of how power is utilized and controlled at the firearm training device. As an example, power settings 348 can define a duration of time between a last interaction or movement of the firearm training device and a power down function in which electronic components of the training device are turned off. As another example, power settings 348 can defined one or more inputs for turning off the firearm training device. For example, the user can remove the magazine and/or actuate the trigger for a threshold period of time to turn off the firearm training device to conserve power. Settings 220 can further include one or more other settings 350.

Figure 4:
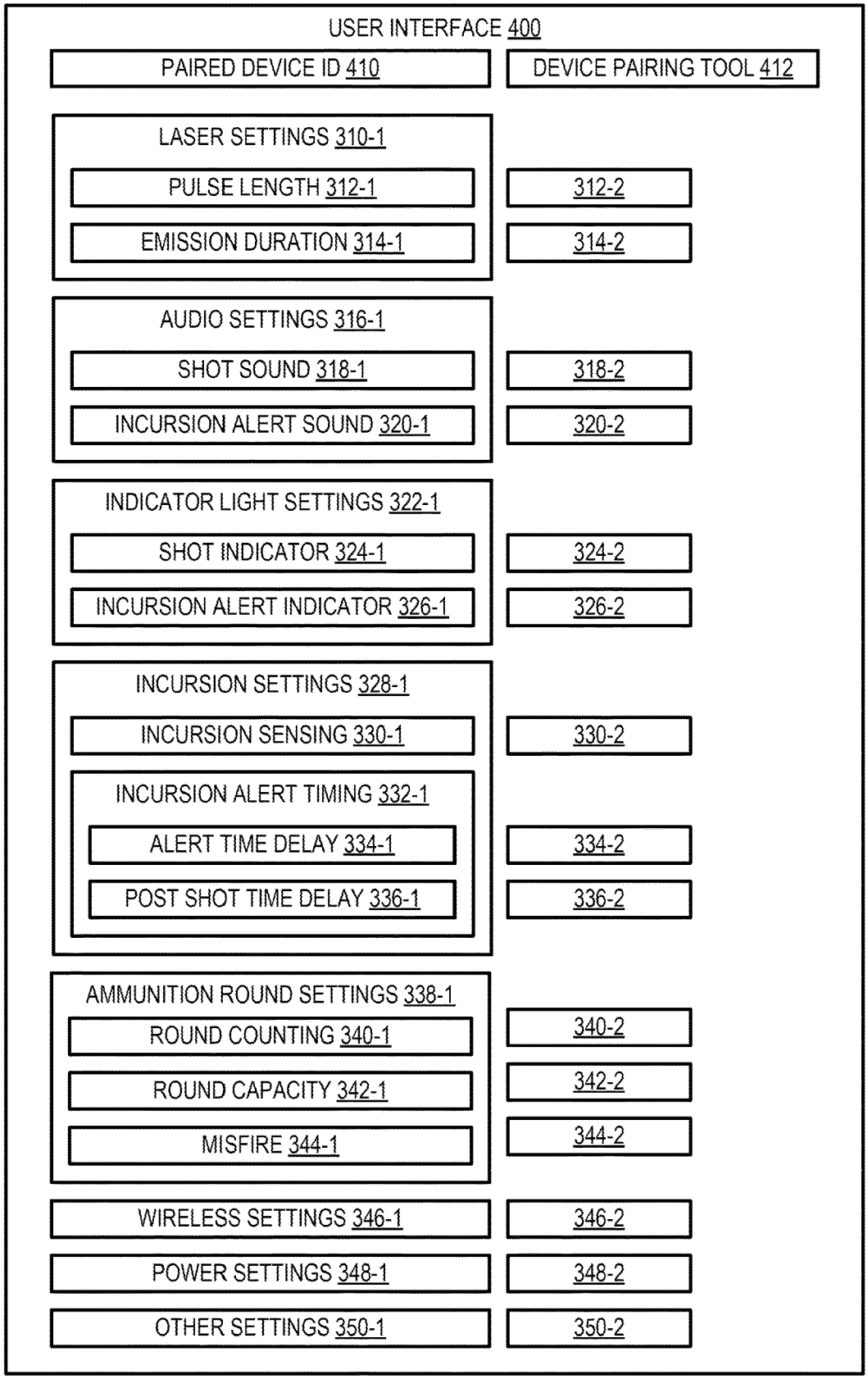
FIG. 4 is an example user interface by which the settings of FIG. 3 can be accessed, presented, and adjusted by a user.

FIG. 4 is an example user interface 400 by which the settings 220 of FIG. 3 can be accessed, presented, and adjusted by a user. User interface 400 is an example of previously described user interface 250 of FIG. 2. In at least some examples, user interface 400 can take the form of a graphical user interface that is presented via a computing system, such as remote computing system 252 of FIG. 2.

Within FIG. 4, example setting values and setting identifiers for each of the previously described settings of FIG. 3 are represented schematically using the same reference numerals with an appended "-1" reference numeral. Additionally, within FIG. 4, example setting adjustment tools for each of the previously described settings of FIG. 3 are represented schematically using the same reference numerals with an appended "-2" reference numeral. Each adjustment tool is operable by a user to define an adjustment to one or more values of the corresponding setting. Each adjustment tool can include a selector, menu of supported value ranges, and/or field by which setting values can be input or selected by a user, for example.

User interface 400 further includes an identifier 410 of a firearm training device with which a remote device presenting the user interface is paired. User interface 400 further includes a device pairing tool 412 that enables a user to pair the remote device with the firearm training device, such as over a wireless communications link.

FIG. 5 is a flow diagram depicting an example method 500 that can be performed by electronic control system 120 of firearm training device 100.

At 510, the method includes reading current settings (e.g., 220) stored on the electronic control system. As an example, electronic control system 120 accesses and references settings 220 stored on storage machine 214, including the example settings described with reference to FIG. 3.

At 512, the method includes receiving a command to update a setting at the electronic control system. The command can identify the setting from among a plurality of current settings and one or more values and/or selections for the updating the setting.

The command can be received via an input device onboard the firearm training device as indicated at 514. As an example, the command can be received as a set of predefined actuations of the trigger as detected by the electronic control system via the trigger sensor. In this example, the set of predefined actuations of the trigger can include an initial actuation of the trigger for a threshold duration of time (e.g., 9 seconds) that defines entry of a settings menu of the electronic control system, and one or more additional actuations of the trigger that defines the change of the setting. For example, each additional actuation can cycle through a predefined list of settings. As another example, each additional actuation can cycle through a predefined list of values for a given setting. As yet another example, each setting can be identified by a predefined sequence of trigger actuations that provide a unique code for accessing a corresponding setting. Once a particular setting has been accessed, additional trigger actuations can be used to cycle through a predefined list of values for that setting and/or a subsequent predefined sequence of trigger actuations can provide a unique code that sets the value for the setting.

Alternatively, the command can be received via a communications link (e.g., wireless or wired) as indicated at 516. As an example, the electronic control system can include a wireless communications interface, and the command can be received over a wireless communications link via the wireless communications interface from a remote computing system (e.g., 230). The electronic control system can be configured to establish the wireless communications link responsive to a set of one or more predefined actuations of the trigger or other input device, as examples. Furthermore, the remote computing system can have an application stored thereon executable by the remote computing system to: output, at the remote computing system, the one or more laser settings of the settings data stored on the electronic control system, receive a user input that defines the command (e.g., via one or more user interfaces 250) of program 252, and send the command to the firearm training device via the wireless communications link.

At 518, the method includes updating the setting within the current settings stored on the electronic control system based on the command.

As an example, the electronic control system can receive a command to change a laser setting of the one or more laser settings stored on the electronic control system that defines the pulse length and/or the emission duration of the laser to be emitted by the laser emitter, and can update the laser setting stored on the electronic control system based on the command to vary the pulse length and/or the emission duration of the laser to be emitted by the laser emitter responsive to actuation of the trigger as detected via the trigger sensor.

As another example, the electronic control system can receive a command to change an output setting of the one or more output settings stored on the electronic control system; and update the output setting stored on the electronic control system based on the command to vary the output provided by one or more output devices of the firearm training system responsive to actuation of the trigger.

As another example, the electronic control system can receive a command to change an output setting of the one or more output settings stored on the electronic control system; and update the output setting stored on the electronic control system based on the command to vary the output provided by the one or more output devices responsive to incursion of the object as detected via the trigger region incursion sensor. The one or more output settings can define an output to be provided via one or more output devices of the firearm training system responsive to detection of incursion of objects within the trigger region via the trigger region incursion sensor.

As another example, the electronic control system can receive a command to change the duration of time defined by the delay setting stored on the electronic control system between incursion detected via the trigger region incursion sensor and actuation of the trigger as detected via the trigger sensor; and update the delay setting stored on the electronic control system based on the command to vary the duration of time.

As another example, the settings stored on the electronic control system can include one or more ammunition round settings that define a threshold quantity of actuations of the trigger as detected via the trigger sensor, thereby simulating an ammunition round capacity. In this example, the electronic control system can receive a command to change the threshold quantity of actuations; and update the one or more ammunition round setting to define the change to the threshold quantity of actuations.

As another example, the one or more ammunition round settings can define activation or deactivation of a simulated misfire event state. In this example, the electronic control system can receive a command to change can activate or deactivate the simulated misfire event state; and update the one or more ammunition round setting to define the simulated misfire event state to activated or deactivated.

At 520, the method includes implementing the current settings at the firearm training device via the electronic control system. An example implementation of the current settings at 520 is described in further detail with reference to various suboperations.

At 522, the electronic control system can detect incursion of an object within the trigger region via the trigger region incursion sensor. At 524, the electronic control system determines whether a duration of time as defined by the delay setting has been attained or exceeded between incursion of the object and actuation of the trigger as detected via the trigger sensor.

Responsive to the duration of time being attained or exceeded, the electronic control system can control one or more output devices of the firearm training system at 526 to provide an output based on the current settings, including controlling laser emitter 124 at 528, controlling audio speaker 246 at 530, and/or controlling indicator light 126 at 532 to provide a predefined output indicative of the duration of time being attained or exceeded. In this example, the electronic control system can control the one or more output devices to provide the output defined by the one or more output settings stored on the electronic control system.

At 534, the electronic control system can record an event (e.g., within events data 222) identifying that the duration of time has been attained or exceeded.

At 540, the electronic control system can detect actuation of trigger 112 via trigger actuation sensor 240. At 542, the electronic control system can determine whether the threshold quantity of actuations defined by the one or more ammunition round settings has been attained or exceeded. At 544, responsive to the quantity of actuations of the trigger attaining or exceeding the threshold quantity, the electronic control system can output an indication of a reload requirement. The output can be provided via an output device of the firearm training system (e.g., the laser emitter, the audio speaker, the indicator light, etc.) and an event identifying the reload requirement can be stored in events data 222. At 546, the electronic control system can detect a simulated reload action, such as release and reinsertion of ammunition magazine 116 as detected by magazine sensor 242. At 548, the electronic control system can reset the quantity of actuations to zero responsive to each simulated reload action. Alternatively, the system can reset the quantity of actuations to the simulated capacity of the ammunition magazine and each trigger actuation can result in decrementing the quantity.

At 550, the electronic control system can determine whether a simulated misfire event is to be generated based on the one or more ammunition settings defining either an activated state or deactivated state of the simulated misfire. Where a simulated misfire event is to be generated, the electronic control system can output indication of a reload requirement at 544. At 546, the electronic control system can detect a simulated reload action, such as discussed above with reference to the magazine sensor. At 548, the electronic control system can reset the quantity of actuations, as discussed above.

At 560, the electronic control system can control one or more output devices on-board the firearm training device based on the current settings to provide an output responsive to actuation of the trigger, including controlling the laser emitter at 562, controlling the audio speaker at 564, and/or controlling the indicator light at 566.

As an example, responsive to actuation of the trigger as detected via the trigger sensor, the electronic control system can control the laser emitter to emit the laser at the pulse length and/or the emission duration defined by the one or more laser settings stored on the electronic control system. As another example, responsive to detecting actuation of the trigger, the electronic control system can control the one or more output devices to provide the output defined by the one or more output settings stored on the electronic control system, including sounds settings defining a shot sound or an indicator light setting for the indicator light, as examples.

At 568, the electronic control system can record actuation of the trigger as an event within events data 222.

The methods and operations described herein can be performed by a computing system of one or more computing devices. In particular, such methods and operations may be implemented as a computer-application program or service, an application-programming interface (API), a library, and/or other computer-program product. As described with reference to FIG. 2, for example, electronic control system 120 can include computing system 210. FIG. 2 schematically depicts computing system 210 that can the methods and operations described herein. Computing system 210 is shown in simplified form. Computing system 210 may take the form including logic machine 212 and storage machine 214.

Logic machine 212 includes one or more physical devices configured to execute instructions. For example, the logic machine may be configured to execute instructions that are part of one or more applications, services, programs, routines, libraries, objects, components, data structures, or other logical constructs. Such instructions may be implemented to perform a task, implement a data type, transform the state of one or more components, achieve a technical effect, or otherwise arrive at a desired result.

The logic machine may include one or more processors configured to execute software instructions. Additionally or alternatively, the logic machine may include one or more hardware or firmware logic machines configured to execute hardware or firmware instructions. Processors of the logic machine may be single-core or multi-core, and the instructions executed thereon may be configured for sequential, parallel, and/or distributed processing. Individual components of the logic machine optionally may be distributed among two or more separate devices, which may be configured for coordinated processing.

Storage machine 214 includes one or more physical devices configured to hold instructions (e.g., 216) executable by the logic machine to implement the methods and operations described herein. When such methods and operations are implemented, the state of the storage machine may be transformed—e.g., to hold different data.

The storage machine may include removable and/or built-in devices. The storage machine may include optical memory, semiconductor memory (e.g., RAM, EPROM, EEPROM, etc.), and/or magnetic memory (e.g., MRAM), among others. The storage machine may include volatile, nonvolatile, dynamic, static, read/write, read-only, random-access, sequential-access, location-addressable, file-addressable, and/or content-addressable devices.

It will be appreciated that the storage machine includes one or more physical devices. However, aspects of the instructions described herein alternatively may be propagated by a communication medium (e.g., an electromagnetic signal, an optical signal, etc.) that is not held by a physical device for a finite duration.

Aspects of logic machine 212 and storage machine 214 may be integrated together into one or more hardware-logic components. Such hardware-logic components may include field-programmable gate arrays (FPGAs), program- and application-specific integrated circuits (PASIC/ASICs), program- and application-specific standard products (PSSP/ASSPs), system-on-a-chip (SOC), and complex programmable logic devices (CPLDs), for example.

The terms "module," "program," and "engine" may be used to describe an aspect of computing system 210 implemented to perform a particular function. In some cases, a module, program, or engine may be instantiated via logic machine 212 executing instructions held by storage machine 214. It will be understood that different modules, programs, and/or engines may be instantiated from the same application, service, code block, object, library, routine, API, function, etc. Likewise, the same module, program, and/or engine may be instantiated by different applications, services, code blocks, objects, routines, APIs, functions, etc. The terms "module," "program," and "engine" may encompass individual or groups of executable files, data files, libraries, drivers, scripts, database records, etc.

It will be understood that the configurations and/or approaches described herein are exemplary in nature, and that these specific embodiments or examples are not to be considered in a limiting sense, because numerous variations are possible. The specific routines or methods described herein may represent one or more of any number of processing strategies. As such, various acts illustrated and/or described may be performed in the sequence illustrated and/or described, in other sequences, in parallel, or omitted. Likewise, the order of the above-described processes may be changed.

The subject matter of the present disclosure includes all novel and non-obvious combinations and sub-combinations of the various processes, systems and configurations, and other features, functions, acts, and/or properties disclosed herein, as well as any and all equivalents thereof.

The invention claimed is:

1. A firearm training system, comprising:

a firearm training device including:

a device body that takes the form of a simulated firearm;

a trigger moveably coupled to the device body;

a trigger sensor mounted to the device body to detect actuation of the trigger;

a laser emitter mounted to the device body and configured to emit a laser along a path that simulates a firing trajectory of the simulated firearm;

an electronic control system mounted to the device body and having settings data stored thereon that includes one or more laser settings that defines a pulse length and/or an emission duration of one or more pulses of the laser to be emitted by the laser emitter;

wherein the electronic control system is configured to:

responsive to actuation of the trigger as detected via the trigger sensor, control the laser emitter to emit the laser at the pulse length and/or the emission duration defined by the one or more laser settings stored on the electronic control system;

receive a command to change a laser setting of the one or more laser settings stored on the electronic control system that defines the pulse length and/or the emission duration of the laser to be emitted by the laser emitter, wherein the command is received as a set of predefined actuations of the trigger as detected by the electronic control system via the trigger sensor; and update the laser setting stored on the electronic control system based on the command to vary the pulse length and/or the emission duration of the laser to be emitted by the laser emitter responsive to actuation of the trigger as detected via the trigger sensor.

2. The firearm training system of claim 1, wherein the set of predefined actuations of the trigger includes:

an initial actuation of the trigger for a threshold duration of time that defines entry of a settings menu of the electronic control system, and one or more additional actuations of the trigger that defines the change of the laser setting.

3. The firearm training system of claim 1, further comprising:

one or more output devices including an audio speaker and/or an indication light mounted to the device body;

wherein the settings data stored on the electronic control system further includes one or more output settings that defines an output to be provided via the one or more output devices responsive to actuation of the trigger as detected via the trigger sensor;

wherein the electronic control system is configured to:

responsive to detecting actuation of the trigger, control the one or more output devices to provide the output defined by the one or more output settings stored on the electronic control system;

receive an additional command to change an output setting of the one or more output settings stored on the electronic control system; and update the output setting stored on the electronic control system based on the additional command to vary the output provided by the one or more output devices responsive to actuation of the trigger.

4. The firearm training system of claim 1, further comprising:

a trigger region incursion sensor mounted to the device body to detect incursion of objects within a trigger region neighboring the trigger;

one or more output devices including an audio speaker and/or an indication light mounted to the device body;

wherein the settings data stored on the electronic control system further includes one or more output settings that defines an output to be provided via the one or more output devices responsive to detection of incursion of objects within the trigger region;

wherein the electronic control system is configured to:

responsive to detecting incursion of an object within the trigger region via the trigger region incursion sensor, control the one or more output devices to provide the output defined by the one or more output settings stored on the electronic control system;

receive an additional command to change an output setting of the one or more output settings stored on the electronic control system; and update the output setting stored on the electronic control system based on the additional command to vary the output provided by the one or more output devices responsive to incursion of the object as detected via the trigger region incursion sensor.

5. The firearm training system of claim 1, further comprising:

a trigger region incursion sensor mounted to the device body to detect incursion of objects within a trigger region neighboring the trigger;

wherein the settings data stored on the electronic control system further includes a delay setting that defines a duration of time between incursion detected via the trigger region incursion sensor and actuation of the trigger as detected via the trigger sensor;

wherein the electronic control system is configured to:

output an indication of an incursion event upon detecting incursion via the trigger region incursion sensor without detecting actuation of the trigger within the duration of time defined by the delay setting;

receive an additional command to change the duration of time defined by the delay setting stored on the electronic control system; and update the delay setting stored on the electronic control system based on the additional command to vary the duration of time.

6. The firearm training system of claim 1, further comprising a sensor mounted to the device body and configured to detect simulated reload actions;

wherein the settings data stored on the electronic control system further includes one or more ammunition round settings that define a threshold quantity of actuations of the trigger as detected via the trigger sensor;

wherein the electronic control system is configured to:

record a quantity of actuations of the trigger as detected via the trigger sensor between consecutive simulated reload actions as detected via the sensor;

responsive to the quantity of actuations of the trigger attaining or exceeding the threshold quantity, output an indication of a reload requirement; and reset the quantity of actuations to zero responsive to each simulated reload action.

7. The firearm training system of claim 6, wherein the one or more ammunition round settings further define activation or deactivation of a simulated misfire event state;

wherein the electronic control system is configured to:

generate one or more simulated misfire events based on the one or more ammunition round settings defining activation of the simulated misfire event state;

responsive to each simulated misfire event being generated, output an indication of the reload requirement.

8. A method performed by an electronic control system of a firearm training device that simulates a firearm, the method comprising:

responsive to actuation of as trigger of the firearm training device, controlling a laser emitter of the firearm training device to emit a laser at a pulse length and/or an emission duration of one or more pulses of the laser defined by the one or more laser settings stored on the electronic control system;

receiving a command to change a laser setting of the one or more laser settings stored on the electronic control system that defines the pulse length and/or the emission duration of the laser to be emitted by the laser emitter, wherein the command is received as a set of predefined actuations of the trigger as detected by the electronic control system via a trigger sensor; and updating the laser setting stored on the electronic control system based on the command to vary the pulse length and/or the emission duration of the laser to be emitted by the laser emitter responsive to actuation of the trigger.

9. The method of claim 8, wherein the set of predefined actuations of the trigger includes:

an initial actuation of the trigger for a threshold duration of time that defines entry of a settings menu of the electronic control system, and one or more additional actuations of the trigger that defines the change of the laser setting.

10. The method of claim 8, wherein the settings data stored on the electronic control system further includes one or more output settings that defines an output to be provided via one or more output devices responsive to actuation of the trigger; and wherein the method further comprises:

responsive to detecting actuation of the trigger, controlling the one or more output devices to provide the output defined by the one or more output settings stored on the electronic control system;

receiving an additional command to change an output setting of the one or more output settings stored on the electronic control system; and updating the output setting stored on the electronic control system based on the additional command to vary the output provided by the one or more output devices responsive to actuation of the trigger.

11. The method of claim 8, wherein the settings data stored on the electronic control system further includes one or more output settings that defines an output to be provided via one or more output devices responsive to detection of incursion of objects within the trigger region via a trigger region incursion sensor; and wherein the method further comprises:

responsive to detecting incursion of an object within the trigger region via the trigger region incursion sensor, controlling the one or more output devices to provide the output defined by the one or more output settings stored on the electronic control system;

receiving an additional command to change an output setting of the one or more output settings stored on the electronic control system; and updating the output setting stored on the electronic control system based on the additional command to vary the output provided by the one or more output devices responsive to incursion of the object as detected via the trigger region incursion sensor.

12. The method of claim 8, wherein the settings data stored on the electronic control system further includes a delay setting that defines a duration of time between incursion detected via a trigger region incursion sensor and actuation of the trigger;

wherein the method further comprises:

outputting an indication of an incursion event upon detecting incursion via the trigger region incursion sensor without detecting actuation of the trigger within the duration of time defined by the delay setting;

receiving an additional command to change the duration of time defined by the delay setting stored on the electronic control system; and updating the delay setting stored on the electronic control system based on the additional command to vary the duration of time.

13. The method of claim 8, wherein the settings data stored on the electronic control system further includes one or more ammunition round settings that define a threshold quantity of actuations of the trigger as detected via the trigger sensor;

wherein the method further comprises:

recording a quantity of actuations of the trigger as detected via the trigger sensor between consecutive simulated reload actions as detected via the sensor;

responsive to the quantity of actuations of the trigger attaining or exceeding the threshold quantity, outputting an indication of a reload requirement; and resetting the quantity of actuations to zero responsive to each simulated reload action.

14. A firearm training system, comprising:

a firearm training device including:

a device body that takes the form of a simulated firearm;

a trigger moveably coupled to the device body;

a trigger sensor mounted to the device body to detect actuation of the trigger;

a laser emitter mounted to the device body and configured to emit a laser along a path that simulates a firing trajectory of the simulated firearm;

an electronic control system mounted to the device body and having settings data stored thereon that includes one or more laser settings that defines a pulse length and/or an emission duration of one or more pulses of the laser to be emitted by the laser emitter;

wherein the electronic control system is configured to:

responsive to actuation of the trigger as detected via the trigger sensor, control the laser emitter to emit the laser at the pulse length and/or the emission duration defined by the one or more laser settings stored on the electronic control system;

receive a command to change a laser setting of the one or more laser settings stored on the electronic control system that defines the pulse length and/or the emission duration of the laser to be emitted by the laser emitter; and update the laser setting stored on the electronic control system based on the command to vary the pulse length and/or the emission duration of the laser to be emitted by the laser emitter responsive to actuation of the trigger as detected via the trigger sensor;

wherein the electronic control system includes a wireless communications interface;

wherein the command is received over a wireless communications link via the wireless communications interface from a remote computing system;

wherein the electronic control system is configured to establish the wireless communications link responsive to a set of one or more predefined actuations of the trigger.

15. The firearm training system of claim 14, further comprising the remote computing system; and wherein the remote computing system has an application stored thereon executable by the remote computing system to:

output, at the remote computing system, the one or more laser settings of the settings data stored on the electronic control system, receive a user input that defines the command, and send the command to the firearm training device via the wireless communications link.

16. The firearm training system of claim 14, further comprising:

one or more output devices including an audio speaker and/or an indication light mounted to the device body;

wherein the settings data stored on the electronic control system further includes one or more output settings that defines an output to be provided via the one or more output devices responsive to actuation of the trigger as detected via the trigger sensor;

wherein the electronic control system is configured to:

responsive to detecting actuation of the trigger, control the one or more output devices to provide the output defined by the one or more output settings stored on the electronic control system;

receive an additional command to change an output setting of the one or more output settings stored on the electronic control system; and update the output setting stored on the electronic control system based on the additional command to vary the output provided by the one or more output devices responsive to actuation of the trigger.

17. The firearm training system of claim 14, further comprising:

a trigger region incursion sensor mounted to the device body to detect incursion of objects within a trigger region neighboring the trigger;

one or more output devices including an audio speaker and/or an indication light mounted to the device body;

wherein the settings data stored on the electronic control system further includes one or more output settings that defines an output to be provided via the one or more output devices responsive to detection of incursion of objects within the trigger region;

wherein the electronic control system is configured to:

responsive to detecting incursion of an object within the trigger region via the trigger region incursion sensor, control the one or more output devices to provide the output defined by the one or more output settings stored on the electronic control system;

receive an additional command to change an output setting of the one or more output settings stored on the electronic control system; and update the output setting stored on the electronic control system based on the additional command to vary the output provided by the one or more output devices responsive to incursion of the object as detected via the trigger region incursion sensor.

18. The firearm training system of claim 14, further comprising:

a trigger region incursion sensor mounted to the device body to detect incursion of objects within a trigger region neighboring the trigger;

wherein the settings data stored on the electronic control system further includes a delay setting that defines a duration of time between incursion detected via the trigger region incursion sensor and actuation of the trigger as detected via the trigger sensor;

wherein the electronic control system is configured to:

output an indication of an incursion event upon detecting incursion via the trigger region incursion sensor without detecting actuation of the trigger within the duration of time defined by the delay setting;

receive an additional command to change the duration of time defined by the delay setting stored on the electronic control system; and update the delay setting stored on the electronic control system based on the additional command to vary the duration of time.

19. The firearm training system of claim 14, further comprising a sensor mounted to the device body and configured to detect simulated reload actions;

wherein the settings data stored on the electronic control system further includes one or more ammunition round settings that define a threshold quantity of actuations of the trigger as detected via the trigger sensor;

wherein the electronic control system is configured to:

record a quantity of actuations of the trigger as detected via the trigger sensor between consecutive simulated reload actions as detected via the sensor;

responsive to the quantity of actuations of the trigger attaining or exceeding the threshold quantity, output an indication of a reload requirement; and reset the quantity of actuations to zero responsive to each simulated reload action.

20. The firearm training system of claim 19, wherein the one or more ammunition round settings further define activation or deactivation of a simulated misfire event state;

wherein the electronic control system is configured to:

generate one or more simulated misfire events based on the one or more ammunition round settings defining activation of the simulated misfire event state;

responsive to each simulated misfire event being generated, output an indication of the reload requirement.

* * * * *